US008764580B2

(12) United States Patent
Ishii et al.

(10) Patent No.: US 8,764,580 B2
(45) Date of Patent: Jul. 1, 2014

(54) GOLF BALL HAVING RELATIONSHIPS AMONG THE DENSITIES OF VARIOUS LAYERS

(75) Inventors: Hideyuki Ishii, Portland, OR (US); Chien-Hsin Chou, Yun-lin Hsien (TW); Yasushi Ichikawa, Tualatin, OR (US); Che-Ching Lin, Chiayi (TW); Chen-Tai Liu, Yun-lin Hsien (TW); Arthur Molinari, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 293 days.

(21) Appl. No.: 13/250,305

(22) Filed: Sep. 30, 2011

(65) Prior Publication Data

US 2013/0085015 A1 Apr. 4, 2013
US 2013/0244811 A9 Sep. 19, 2013

(51) Int. Cl.
*A63B 37/04* (2006.01)
*A63B 37/12* (2006.01)

(52) U.S. Cl.
USPC ..... 473/368; 473/376; 473/377

(58) Field of Classification Search
USPC ..... 473/351–378
See application file for complete search history.

(56) References Cited

U.S. PATENT DOCUMENTS 4,836,552 A 6/1989 Puckett et al.
5,273,286 A 12/1993 Sun
5,713,802 A 2/1998 Moriyama et al.
5,779,562 A * 7/1998 Melvin et al. ..... 473/373
5,779,563 A * 7/1998 Yamagishi et al. ..... 473/371
5,830,087 A 11/1998 Sullivan et al.
6,045,460 A * 4/2000 Hayashi et al. ..... 473/376
6,180,722 B1 * 1/2001 Dalton et al. ..... 525/193
6,248,027 B1 * 6/2001 Hayashi et al. ..... 473/371
6,299,550 B1 10/2001 Molitor et al.
6,358,159 B1 * 3/2002 Yamagishi et al. ..... 473/374
6,379,269 B1 * 4/2002 Nesbitt et al. ..... 473/371
6,634,964 B2 * 10/2003 Jordan et al. ..... 473/377
6,638,184 B2 * 10/2003 Nesbitt et al. ..... 473/372
6,685,579 B2 2/2004 Sullivan
6,780,126 B2 * 8/2004 Ladd et al. ..... 473/376

(Continued)

FOREIGN PATENT DOCUMENTS

CN ZL201220503827.0 5/2013
EP 2327456 6/2011

OTHER PUBLICATIONS

Notification of Grant for Utility Model Patent Right in Chinese Patent Application No. 20122053827.0, issued on Feb. 8, 2013.

(Continued)

*Primary Examiner* — Alvin Hunter
(74) *Attorney, Agent, or Firm* — Quinn Law Group, PLLC

(57) ABSTRACT

A four piece golf ball includes several relationships among the values of the densities of its layers. Namely, the sum of the density of the inner core and the outer core is at least 2 g/cm$^3$, the sum of the density of the inner cover layer and the outer cover layer is at least 2.2 g/cm$^3$, and the difference between these two sums is at least 0.1 g/cm$^3$. The inner core is made of a highly neutralized acid polymer, the outer core is made of a polybutadiene rubber, and the inner and outer cover layers are made of a non-ionomeric thermoplastic material, such as thermoplastic polyurethane. The layers may have certain relationships among their hardness values. Finally, the golf ball exhibits certain physical properties, such as a certain moment of inertia.

13 Claims, 1 Drawing Sheet

(56) References Cited

U.S. PATENT DOCUMENTS

| | | | | |
|---|---|---|---|---|
| 6,890,271 | B2 * | 5/2005 | Ladd et al. | 473/376 |
| 6,916,254 | B2 * | 7/2005 | Ladd et al. | 473/376 |
| 6,939,249 | B2 | 9/2005 | Sullivan | |
| 6,982,301 | B1 * | 1/2006 | Voorheis et al. | 525/193 |
| 6,994,638 | B2 * | 2/2006 | Rajagopalan et al. | 473/377 |
| 7,001,287 | B2 * | 2/2006 | Ladd et al. | 473/376 |
| 7,004,857 | B2 * | 2/2006 | Ladd et al. | 473/376 |
| 7,009,002 | B2 | 3/2006 | Rajagopalan et al. | |
| 7,094,160 | B2 * | 8/2006 | Ladd et al. | 473/376 |
| 7,134,973 | B2 * | 11/2006 | Ladd et al. | 473/376 |
| 7,195,569 | B2 * | 3/2007 | Ladd et al. | 473/376 |
| 7,354,357 | B2 | 4/2008 | Sullivan et al. | |
| 7,357,735 | B2 | 4/2008 | Sullivan et al. | |
| 7,361,102 | B2 * | 4/2008 | Ladd et al. | 473/376 |
| 7,361,103 | B2 * | 4/2008 | Ladd et al. | 473/376 |
| 7,371,192 | B2 * | 5/2008 | Sullivan et al. | 473/376 |
| 7,537,531 | B2 * | 5/2009 | Ladd et al. | 473/376 |
| 7,648,427 | B2 | 1/2010 | Isogawa | |
| 7,651,415 | B2 | 1/2010 | Ladd et al. | |
| 7,652,086 | B2 * | 1/2010 | Sullivan et al. | 524/322 |
| 7,654,918 | B2 * | 2/2010 | Bartsch et al. | 473/377 |
| 7,722,482 | B2 * | 5/2010 | Sullivan et al. | 473/376 |
| 7,749,108 | B2 | 7/2010 | Watanabe et al. | |
| 7,806,783 | B2 * | 10/2010 | Ladd et al. | 473/376 |
| 7,918,750 | B2 * | 4/2011 | Sullivan et al. | 473/376 |
| 7,927,524 | B2 | 4/2011 | Vora et al. | |
| 7,980,965 | B2 * | 7/2011 | Sullivan et al. | 473/376 |
| 8,556,748 | B2 * | 10/2013 | Sullivan et al. | 473/376 |
| 2001/0005697 | A1 | 6/2001 | Dougan et al. | |
| 2002/0151381 | A1 | 10/2002 | Sullivan | |
| 2004/0171436 | A1 | 9/2004 | Sullivan | |
| 2006/0234812 | A1 | 10/2006 | Ladd et al. | |
| 2009/0181802 | A1 | 7/2009 | Sullivan et al. | |
| 2010/0323820 | A1 | 12/2010 | Sullivan et al. | |
| 2011/0053707 | A1 | 3/2011 | Ishii et al. | |
| 2011/0130220 | A1 | 6/2011 | Ichikawa et al. | |
| 2011/0177885 | A1 | 7/2011 | Ichikawa | |
| 2012/0004052 | A1 | 1/2012 | Chou et al. | |

OTHER PUBLICATIONS

International Search Report mailed Mar. 15, 2013 for PCT Application No. PCT/US2012/055907.

* cited by examiner

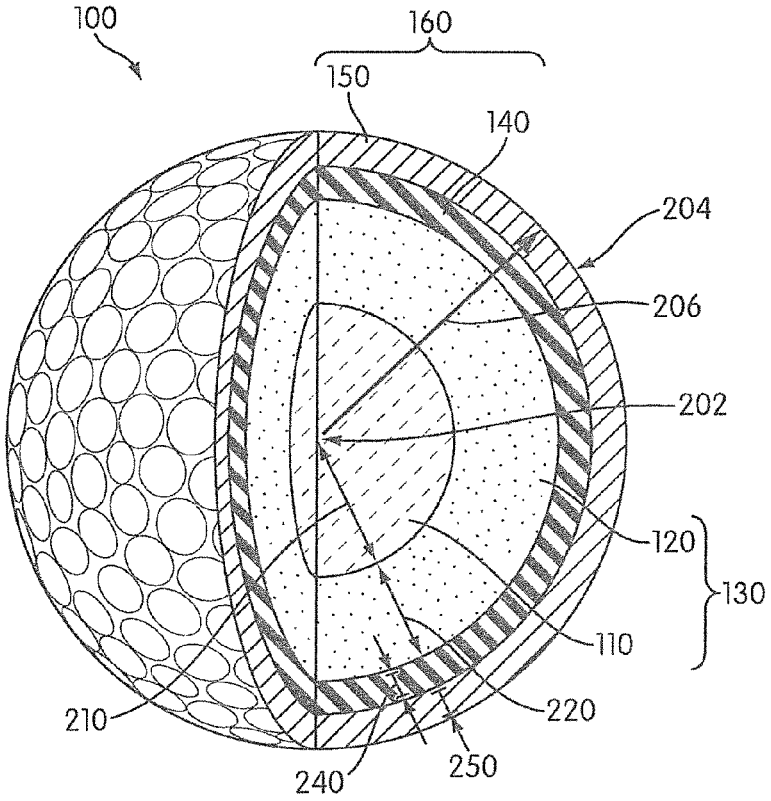
100
160
150
140
204
206
202
120
130
110
220
210
240
250

GOLF BALL HAVING RELATIONSHIPS AMONG THE DENSITIES OF VARIOUS LAYERS

BACKGROUND

The present invention relates generally to golf balls having certain relationships among the densities of the various layers therein. The relationships among the densities may cause the golf ball to have certain values of its moment of inertia, which may result in favorable play characteristics.

Conventional multi-piece solid golf balls commonly include a solid resilient core having single or multiple layers, and at least one cover layer molded on the solid core. The solid core for a multi-piece solid golf ball is often formed from a combination of materials such as polybutadiene and other rubbers crosslinked with zinc diacrylate or zinc dimethacrylate. The cover is typically made of ionomeric resins that impart toughness and cut resistance.

Ionomeric resins are generally ionic copolymers of an olefin, such as ethylene, and a metal salt of an unsaturated carboxylic acid, such as acrylic acid, methacrylic acid or maleic acid. Metal ions, such as sodium or zinc, are used to neutralize some portion of the acidic group in the copolymer. Ionomeric resins often exhibit useful properties, such as durability, for golf ball cover construction.

However, while ionomeric resins may have favorable durability, they also may exhibit unfavorable playability. Specifically, ionomeric resins tend to be quite hard. Ionomeric resins thus may lack the degree of softness required to impart the spin necessary to control the ball in flight. Namely, ionomeric resin covers do not compress as much against the face of the club upon impact due to their high hardness, thereby producing less spin. In addition, the harder and more durable ionic resins lack the "feel" characteristic associated with softer covers, such as traditional balata covers.

As is generally known, one property of a golf ball that may affect its spin is its moment of inertia. Moment of inertia, also referred to as "MOI" in the art and herein, is a measure of the resistance to twisting about a central axis. The higher the MOI of an object, the more force will be required to change the object's rotationally velocity. Conversely, the lower the MOI, the less force will be needed to change how fast the object rotates.

A golf ball having a high moment of inertia may exhibit advantageous play characteristics. For example, such a golf ball will typically have a lower rate of spin upon initially being struck by a golf club than a golf ball having a lower moment of inertia, as the high moment of inertia will initially resist the increase in the golf ball's rate of spin. Lower initial spin may result in the shot having a greater total distance. At the same time, the golf ball having a high moment of inertia may also have an increased rate of spin later during the flight path of the shot as compared to a golf ball having a lower moment of inertia, as the rate of spin slows from its maximum at a lower rate. Increase spin at this stage of the shot may result in better control on the green, and may also reduce the undesirable effects of cross-winds on the golf ball's trajectory.

Golf balls with increased moment of inertia are known in the art. For example, U.S. Pat. No. 6,939,249 to Sullivan discloses a "Golf Ball Having a High Moment of Inertia," the disclosure of which is herein incorporated by reference in its entirety. However, known golf balls are generally limited to the certain constructions and materials used to achieve the high moment of inertia.

Therefore, there exists a need in the art for a golf ball having an advantageous construction that leads to improved spin characteristics.

SUMMARY

In one aspect, this disclosure provides a golf ball, comprising: an inner core; an outer core, the outer core substantially surrounding the inner core; an inner cover layer, the inner cover layer substantially surrounding the outer core; and an outer cover layer, the outer cover layer substantially surrounding the inner cover layer. The inner core has a first density value, the outer core has a second density value, the inner cover layer has a third density value, and the outer cover layer has a fourth density value. The sum of the first density value and the second density value is at least about 2 g/cm$^3$; the sum of the third density value and the fourth density value is at least about 2.2 g/cm$^3$; and the sum of the third density value and the fourth density value is at least about 0.1 g/cm$^3$ greater than the sum of the first density value and the second density value.

In another aspect, this disclosure provides a golf ball, comprising: an inner core; an outer core, the outer core substantially surrounding the inner core; an inner cover layer, the inner cover layer substantially surrounding the outer core; and an outer cover layer, the outer cover layer substantially surrounding the inner cover layer. The inner core has a first density value, the first density value being from about 0.85 g/cm$^3$ and about 1.1 g/cm$^3$; the outer core has a second density value, the second density value being from about 1.05 g/cm$^3$ to about 1.25 g/cm$^3$; the inner cover layer has a third density value, the third density value being from about 1.05 g/cm$^3$ to about 1.5 g/cm$^3$; and the outer cover layer has a fourth density value, the fourth density value being from about 1 g/cm$^3$ and about 1.8 g/cm$^3$. The sum of the first density value and the second density value is at least about 2 g/cm$^3$; the sum of the third density value and the fourth density value is at least about 2.2 g/cm$^3$; and the sum of the third density value and the fourth density value is at least about 0.1 g/cm$^3$ greater than the sum of the first density value and the second density value. The inner core has a first Shore D hardness value, the outer core has a second Shore D hardness value, the inner cover layer has a third Shore D hardness value, and the outer cover layer has a fourth Shore D hardness value. The third Shore D hardness value is greater than each of the first Shore D hardness value, the second Shore D hardness value, and the fourth Shore D hardness value; the third Shore D hardness value is at least about 10 greater than the fourth Shore D hardness value. The golf ball has a moment of inertia of from about 82 g-cm$^2$ to about 90 g-cm$^2$.

In a third aspect, this disclosure provides a golf ball, comprising: an inner core comprising a highly neutralized acid polymer; an outer core comprising a polybutadiene rubber, the outer core substantially surrounding the inner core; an inner cover layer comprising a non-ionomeric thermoplastic material selected from the group consisting of a polyamide resin, a polyurethane resin, a polyester resin, and combinations thereof; the inner cover layer substantially surrounding the outer core; and an outer cover layer comprising a non-ionomeric thermoplastic material selected from the group consisting of a polyamide resin, a polyurethane resin, a polyester resin, and combinations thereof; the outer cover layer substantially surrounding the inner cover layer. The inner core has a first density value, and diameter of from about 21 mm to about 30 mm; the outer core has a second density value; the inner cover layer has a third density value, and thickness of from about 0.5 mm to about 1.2 mm; the outer cover layer has a fourth density value, and a thickness of from about 0.6 mm to about 2 mm, the thickness of the outer cover layer being equal to or greater than the thickness of the inner cover layer. The sum of the first density value and the second density value is at least about 2 g/cm$^3$; the sum of the third density value and the fourth density value is at least about 2.2 g/cm$^3$; and the sum of the third density value and the fourth density value is at least about 0.1 g/cm$^3$ greater than the sum of the first density value and the second density value. The inner core has a first Shore D hardness value, the outer core has a second Shore D hardness value, the inner cover layer has a third Shore D hardness value, the outer cover layer has a fourth Shore D hardness value. The third Shore D hardness value is greater than each of the first Shore D hardness value, the second Shore D hardness value, and the fourth Shore D hardness value, and the third Shore D hardness value is at least about 10 greater than the fourth Shore D hardness value. The golf ball has a moment of inertia of from about 82 g-cm$^2$ to about 90 g-cm$^2$, and the golf ball has a total diameter of about 1.680 inches.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWING

The invention can be better understood with reference to the following drawing and description. The components in the FIGURE are not necessarily to scale, emphasis instead being placed upon illustrating the principles of the invention. Moreover, in the FIGURE, like reference numerals designate corresponding parts throughout.

The FIGURE is a cut-away cross-sectional view of a golf ball in accordance with this disclosure.

DETAILED DESCRIPTION

Generally, this disclosure provides a golf ball with certain relationships among the values of the densities of the layers making up the golf ball. The golf ball may be a four piece golf ball, in some embodiments. In a four piece ball, the relationships of the density values may be such that the sum of the densities of the inner layers is less than the sum of the densities of the outer layers.

Except as otherwise discussed herein below, any golf ball discussed herein may generally be any type of golf ball known in the art. Namely, unless the present disclosure indicates to the contrary, a golf ball may generally be of any construction conventionally used for golf balls, and may be made of any of the various materials known to be used in golf ball manufacturing. Furthermore, it is understood that any feature disclosed herein (including but not limited to various embodiments shown in the FIGURE and various chemical formulas or mixtures) may be combined with any other features disclosed here, as may be desired.

The FIGURE shows one embodiment of a golf ball in accordance with this disclosure. In the FIGURE, golf ball 100 is a four piece golf ball. Specifically, golf ball 100 includes inner core 110, outer core 120, inner cover layer 140, and outer cover layer 150. The FIGURE is not necessarily to scale, and is shown for illustrative purposes. Various aspects of a golf ball in accordance with this disclosure may have relative proportions and sizes other than are shown in the FIGURE.

Generally, four piece golf balls include at least four structural layers. These structural layers may include an inner core (also referred to as "the core"), an outer core (also referred to as an "mantle" layer, or intermediate layer), an inner cover layer, and an outer cover layer. Four piece golf ball may also include other layers, such as coatings like paint or clear coatings that are generally considered ornamental finishing coatings rather than structural layers.

Golf balls in accordance with this disclosure generally include at least four layers. However, golf balls in accordance with this disclosure may also include one or more additional layers. For example, with reference to the embodiment in the FIGURE, an additional layer may be added at some point between inner core 110 and outer cover layer 150. For example, in other embodiments, an additional cover layer may be inserted between inner cover layer 140 and outer cover layer 150. In other embodiments, an additional core layer may be inserted between inner core layer 110 and outer core 120. Such additional layers may be added by a person having ordinary skill in the art of golf ball manufacturing in accordance with industry practice.

Each of the layers making up the golf ball construction shown in the FIGURE, and their associated physical properties, will be discussed herein below. As used herein, unless otherwise stated, the following physical properties are defined and measured as follows.

The term "compression deformation" as used herein indicates the deformation amount of the ball under a force. Specifically, the compression deformation value of a golf ball or some component of a golf ball is defined as the difference between the amount of deformation under a 10 kg load and the amount of deformation under a 130 kg load.

The term "hardness" as used herein is measured generally in accordance with ASTM D-2240. The hardness of a golf ball is measured on the land area of a curved surface of a molded ball. The hardness of a golf ball sub-component is measured on the curved surface of the molded sub-component. The hardness of a material is measured in accordance with ASTM D-2240 (on a plaque).

The term "coefficient of restitution" ("COR") as used herein is measured according to the method: a golf ball or golf ball sub-component is fired by an air cannon at an initial velocity of 40 m/sec, and a speed monitoring device is located over a distance of 0.6 to 0.9 meters from the cannon, when the golf ball or golf ball sub-component strikes a steel plate positioned about 1.2 meters away from the air cannon, the golf ball or golf ball sub-component rebounds through the speed-monitoring device. The COR is the return velocity divided by the initial velocity. All COR values discussed herein are measured at an initial velocity of 40 m/sec unless otherwise indicated.

The term "flexural modulus" as used herein is the measurement of a material as measured in accordance with ASTM D-790.

First, inner core 110 is the innermost layer of golf ball 100. Inner core 110 includes golf ball center 202 at its center, and may generally be spherical as shown. However, in other embodiments, a golf ball inner core may be non-spherical. In embodiments where inner core 110 is generally spherical, inner core 110 may have radius 210 as shown. The value of radius 210 may be from about 10.5 mm to about 15 mm, or from about 11 mm to about 14.5 mm. In other words, inner core 110 may have a diameter in the range of from about 21 mm to about 30 mm, or from about 22 mm to about 29 mm.

Inner core 110 may be made from a highly neutralized acid polymer composition. Exemplary highly neutralized acid polymer ("HPF") compositions include HPF resins such as HPF1000, HPF2000, HPF AD1027, HPF AD1035, HPF AD1040, and combinations thereof, all produced by E.I. DuPont de Nemours and Company. Inner core 110 may comprise at least one highly neutralized acid polymer. In other embodiments, inner core 110 may consist essentially of one or more highly neutralized acid polymers. In yet other embodiments, inner core may consist essentially of a mixture of at least two highly neutralized acid polymers.

Suitable highly neutralized acid polymer compositions for use in forming inner core 110 may comprise a highly neutralized acid polymer composition and optionally additives, fillers, and/or melt flow modifiers. The acid polymer may be neutralized to 70% or higher, including up to 100%, with a suitable cation source, such as magnesium, sodium, zinc, or potassium.

Suitable additives and fillers for use in inner core 100 may include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., inner core material that is ground and recycled; and nano-fillers. Suitable melt flow modifiers include, for example, fatty acids and salts thereof, polyamides, polyesters, polyacrylates, polyurethanes, polyethers, polyureas, polyhydric alcohols, and combinations thereof.

Inner core 110 may have a variety of physical properties.

First, inner core 110 may have a high resilience. Namely, inner core layer 110 may have a COR value from about 0.79 to about 0.89, or from about 0.8 to about 0.89. The COR of inner core 110 may be greater than the COR value of golf ball 100, by at least about 0.01. In comparison, golf ball 100 may have a COR of at least about 0.775.

Inner core 110 may have a compression deformation value in a range of from about 2.5 mm to about 5 mm. In some embodiments, inner core 110 may have a compression deformation value in a range of from about 3 mm to about 5 mm. In some embodiments, inner core 110 may have a flexural modulus value in a range of from about 5,000 psi to about 55,000 psi, or from about 5,000 psi to about 45,000 psi.

To have a stable performance, inner core 110 may have a Shore D cross-sectional hardness of from 40 to 60 at any single point on a cross-section obtained by cutting said inner core layer in half, and may have a Shore D cross-sectional hardness difference between any two points on the cross-section of within ±6.

In particular, inner core 110 may have a certain density value. The density of inner core 100 may have a value of from about 0.85 g/cm$^3$ to about 1.1 g/cm$^3$. In some embodiments, the density of inner core 110 may have a value of from about 0.9 g/cm$^3$ to about 1.1 g/cm$^3$.

Inner core 110 may be manufactured by methods such as hot-press molding or injection molding. When inner core 110 is manufactured by injection molding, the temperature of an injection molding machine may be controlled to be between 195° C. to 225° C.

Outer core 120 substantially surrounds inner core 110. As shown in the FIGURE, the outer surface of outer core 120 may be spherical. However, in other embodiments this is not necessarily the case. As mentioned above, outer core 120 may also be referred to as a mantle layer or an intermediate layer. Outer core 120 may have a thickness 220 as shown. The value of thickness 220 is not particularly limited. In some embodiments, golf ball 100 may be a regulation golf ball that meets USGA requirements. In such embodiments, the USGA requires that the total diameter of the golf ball be at least 1.680 inches. Therefore, twice the sum of the radius of inner core 110, the thickness of other layers (discussed below), and thickness 220 may be at least 1.680 inches (42.67 mm). In some embodiments, the total diameter is equal to about 1.680 inches.

Outer core 120 may generally be made from thermoplastic materials or thermoset materials. An outer core 120 made from thermoset material typically is made by crosslinking a polybutadiene rubber composition. Polybutadiene may be blended with minor amounts of other rubbers. Specifically, a proportion of polybutadiene in the entire base rubber is may be equal to or greater than about 50% by weight, and may be equal to or greater than about 80% by weight. A polybutadiene having a proportion of cis-1,4 bonds of equal to or greater than about 60 mol %, and further, equal to or greater than about 80 mol % is preferred. In some embodiments, cis-1,4-polybutadiene may be used as the base rubber and mixed with other ingredients. In some embodiments, the amount of cis-1,4-polybutadiene may be at least about 50 parts by weight, based on 100 parts by weight of the rubber compound.

In some embodiments, a polybutadiene synthesized using a rare earth element catalyst may be used. Excellent resilience performance of a golf ball may be achieved by using this polybutadiene. Examples of rare earth element catalysts include lanthanum series rare earth element compounds. Other catalysts may include an organoaluminum compound, an alumoxane, and halogen containing compounds. A lanthanum series rare earth element compound is typical. Polybutadiene obtained by using lanthanum series rare earth-based catalysts usually employ a combination of lanthanum series rare earth (atomic number of 57 to 71) compounds, but particularly typical is a neodymium compound.

Various additives may also be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties. The filler may be used to increase the overall density of the material. The filler may include zinc oxide, barium sulfate, calcium carbonate, or magnesium carbonate. In some embodiments, zinc oxide may be selected for its advantageous properties. Metal powder, such as tungsten, may alternatively be used as a filler to achieve a desired density.

Outer core 120 may be made by a hot-press molding method. Suitable vulcanization conditions include a vulcanization temperature of between about 130° C. and about 190° C. and a vulcanization time of between 5 and 20 minutes. To obtain the desired rubber crosslinked body for use as outer core 120 in the present invention, the vulcanizing temperature may be at least 140° C. Generally, as is known to a skilled practitioner, the amount of time and the degree of temperature used to effect vulcanization may be inversely related.

In embodiments in which outer core 120 is produced by vulcanizing and curing the rubber composition in the above-described way, advantageous use may be made of a method in which the vulcanization step is divided into two stages: first, the outer core material is placed in an outer core-forming mold and subjected to initial vulcanization so as to produce a pair of semi-vulcanized hemispherical cups, following which a prefabricated inner core layer is placed in one of the hemispherical cups and is covered by the other hemispherical cup, in which state complete vulcanization is carried out.

The surface of inner core 110 placed in the hemispherical cups may be roughened before the placement to increase adhesion between inner core 110 and outer core 120. In some embodiments, the surface of inner core 110 may be precoated with an adhesive before placing inner core 110 into the hemispherical cups, in order to enhance the durability of the golf ball and enable a high rebound.

In some embodiments, the density of outer core 120 may be from about 1.05 g/cm$^3$ to about 1.25 g/cm$^3$. Generally, inner core 110 and outer core 120 may be referred to as the inner layers 130. Inner layers 130 may have a relationship among their respective density values. For example, the sum of the density value of inner core 110 and the density value of the outer core 120 may be at least about 2 g/cm$^3$. In various embodiments, this sum of the density values of the inner layers 130 may be at least about 2.1 g/cm$^3$, or at least about 2.2 g/cm$^3$, or at least about 2.3 g/cm$^3$, or at least about 2.35 g/cm$^3$. Generally, the sum of the densities of the inner layers 130 may take any value within the sum of the ranges of densities of each layer respectively, so long as the sum is at least 2.0 g/cm$^3$. Namely, as mentioned, the density of inner core 110 may be from 0.85 g/cm$^3$ to about 1.1 g/cm$^3$. Therefore, the sum of the densities of the inner layers 130 may have any value of from about 2.0 g/cm$^3$ to about 2.35 g/cm$^3$.

Inner cover layer 140 substantially surrounds outer core 120. Inner cover layer 140 may be spherical on its outer surface, as shown, or another shape in other embodiments not shown. Inner cover layer 140 may also be referred to as an intermediate layer. Inner cover layer 140 may have a thickness 240 as shown in the FIGURE. Thickness 240 may have a value of from about 0.5 mm to about 1.2 mm. In some embodiments, thickness 240 may have a value of from about 0.8 mm to about 1.2 mm. As mentioned above, thickness 240 may be chosen in conjunction with the thickness values of the other layers such that golf ball 100 has the regulation diameter value as required by the USGA.

Inner cover layer 140 may be comprised of a non-ionomeric thermoplastic material. For example, inner cover layer 140 may be comprised of a non-ionomeric thermoplastic material selected from the group consisting of a polyamide resin, a polyurethane resin, a polyester resin, and combinations thereof. In other embodiments, inner cover layer 140 may consistent essentially of a material chosen from the consisting of a polyamide resin, a polyurethane resin, a polyester resin, and combinations thereof. In a particular embodiment, inner cover layer 140 consists essentially of a thermoplastic polyurethane.

Inner cover layer 140 may have a Shore D hardness of at least about 60, as measured on the curved surface. In particular, inner cover layer 140 may have a Shore D hardness in the range of from about 60 to about 80, as measured on the curved surface. Inner cover layer 140 may also have the highest Shore D hardness of any layer present in golf ball 100, in some embodiments.

Inner cover layer 140 may have a density value of from about 1.05 g/cm$^3$ to about 1.5 g/cm$^3$.

Outer cover layer 150 substantially surrounds inner cover layer 140. Outer cover layer 150 may be the outermost structural layer, but may have finishing coatings such as paint and clear-coating layers on top. Outer cover layer 150 may be spherical on its outer surface, as shown, or another shape in other embodiments not shown. Outer cover layer may include a plurality of dimples thereon, as shown. Outer cover layer may have thickness 250 as shown in the FIGURE. Thickness 250 may have a value of from about 0.6 mm to about 2 mm, or from about 0.8 mm to about 2 mm, or from about 1 mm to about 2 mm. Thickness 250 may be equal to or greater than thickness 240 of inner cover layer 140 to impart good feel and good spin performance.

Outer cover layer 150 may also be comprised of a non-ionomeric thermoplastic material. For example, outer cover layer 150 may be comprised of a non-ionomeric thermoplastic material selected from the group consisting of a polyamide resin, a polyurethane resin, a polyester resin, and combinations thereof. In other embodiments, outer cover layer 150 may consistent essentially of a material chosen from the consisting of a polyamide resin, a polyurethane resin, a polyester resin, and combinations thereof. In a particular embodiment, outer cover layer 150 consists essentially of a thermoplastic polyurethane.

In some embodiments, outer cover layer 150 may comprise the same type of material as inner cover layer 140. In other embodiments, outer cover layer 150 may comprise a different material from inner cover layer 140. In some embodiments, these two layers may consist essentially of the same material, or consist essentially of different materials. When outer cover layer 150 comprises the same type of material as inner cover layer 140, good bonding can be achieved between these layers without applying adhesive to the surface of inner cover layer 140. However, when outer cover layer 150 comprises a different material from inner cover layer 140, a proper adhesive may be applied to the surface of inner cover layer 140 in order to achieve good durability.

Outer cover layer 150 may have a Shore D hardness value of from about 45 to about 60, as measured on the curved surface. Furthermore, the Shore D hardness value of outer cover layer 150 may have a specific relationship to the hardness values of other structural components of golf ball 100. For example, the Shore D hardness value of outer cover layer 150 may be at least about 10 less than the Shore D hardness value of inner cover layer 140. In other words, inner cover layer 140 may have a Shore D hardness value that is at least about 10 greater than the Shore D hardness value of outer cover layer 150. Such a relationship may reduce driver spin rate. Furthermore, the sum of the Shore D hardness value of inner cover layer 140 and the Shore D hardness value of outer cover layer 150 may be at least about 120.

Outer cover layer 150 may have a low flexural modulus. The flexural modulus of over cover layer 150 may be in a range of from about 300 psi to about 5,000 psi, from about 300 psi to about 2,000 psi, or from about 300 psi to about 1,000 psi.

Outer cover layer 150 may also have a density value, and certain density relationships. Outer cover layer 150 may have a density value of from about 1 g/cm$^3$ to about 1.8 g/cm$^3$. Furthermore, outer cover layer 150 and inner cover layer 140 may collectively be referred to as the outer layers 160. Outer layers 160 may have a certain density relationship among themselves, and with respect to inner layers 130. Namely, the sum of the density value of inner cover layer 140 and outer cover layer 150 may be at least about 2.2 g/cm$^3$. In various embodiments, the sum of the density value of inner cover layer 140 and outer cover layer 150 may be at least about 2.3 g/cm$^3$, or at least about 2.4 g/cm$^3$, or at least about 2.5 g/cm$^3$, or at least about 2.6 g/cm$^3$, or at least about 2.7 g/cm$^3$, or at least about 2.8 g/cm$^3$, or at least about 2.9 g/cm$^3$, or at least about 3.0 g/cm$^3$, or at least about 3.1 g/cm$^3$, or at least about 3.2 g/cm$^3$, or at least about 3.3 g/cm$^3$. Generally, this sum may take any value between about 2.2 g/cm$^3$ and about 3.3 g/cm$^3$ (based on the upper bound of density value 1.5 g/cm$^3$ for the inner cover layer plus upper bound of density value 1.8 g/cm$^3$ for the outer cover layer).

Furthermore, the sum of the densities of inner layers 130 may have a relationship to the sum of the densities of outer layers 160. For example, the sum of the densities of inner layers 130 may be at least about 0.1 g/cm$^3$ less than the sum of the densities of outer layers 160. In other words, the sum of the density values of inner cover layer 140 and outer cover layer 150 may be at least about 0.1 g/cm$^3$ greater than the sum of the density values of inner core 110 and outer core 120. In a simple algebraic expression:

$$(D_{140}+D_{150})-(D_{110}+D_{120})\geq 0.1\ \text{g/cm}^3$$

In various embodiments, the sum of the density values of outer layers 160 may be greater than the sum of the density values of inner layers 130 by at least about 0.2 g/cm$^3$, or by at least about 0.3 g/cm$^3$, or by at least about 0.4 g/cm$^3$, or at least about 0.5 g/cm$^3$, or at least about 0.6 g/cm$^3$, or at least about 0.7 g/cm$^3$, or at least about 0.8 g/cm$^3$, or at least about 0.9 g/cm$^3$, or at least about 1.0 g/cm$^3$, or at least about 1.1 g/cm$^3$, or at least about 1.2 g/cm$^3$, or at least about 1.3 g/cm$^3$, or equal to about 1.4 g/cm$^3$. Generally, the lowest sum of the densities of inner layers is 0.85 g/cm$^3$ (inner core 110) plus 1.05 g/cm$^3$ (outer core 120)=1.9 g/cm$^3$. The highest sum of the densities of outer layers 160 is 1.5 g/cm$^3$ (inner cover layer 140) plus 1.8 g/cm$^3$ (outer cover layer 150)=3.3 g/cm$^3$. Therefore, the difference may be up to: 3.3 g/cm$^3$−1.9 g/cm$^3$=1.4 g/cm$^3$.

As a result of these various density value relationships, golf ball 100 may achieve a desired moment of inertia. For example, golf ball 100 may have a moment of inertia of from about 82 g-cm$^2$ to about 90 g-cm$^2$. The moment of inertia of golf ball 100 is represented by arrow 206 in the FIGURE. Moment of inertia 206 as shown in the FIGURE indicates that golf ball 100 has a high moment of inertia that is located more towards the surface 204 of golf ball 100 than towards the center 202 of golf ball 100.

Golf ball 100 itself may have other certain physical properties. For example, golf ball 100 may have a ball compression deformation of from about 2.2 mm to about 3.2 mm. In some embodiments, golf ball 100 may have a compression deformation of from about 2.2 mm to about 3 mm. In some embodiments, golf ball 100 may have a compression deformation of from about 2.2 mm to about 2.8 mm.

Finally, a golf ball in accordance with this disclosure may also include features disclosed in any of several co-pending applications, as follows.

A golf ball in accordance with this disclosure may have a thin mantle layer made of thermoplastic polyurethane. In a first embodiment, the golf ball having a thin mantle layer made of thermoplastic polyurethane may have multiple layers comprising a core, a cover layer surrounding the core, the cover layer having a cover hardness, and a mantle layer positioned between the core and the cover layer, the mantle layer having a mantle hardness; wherein the cover hardness is at least 6 Shore D units less than the mantle hardness; and the golf ball has a total volume that is a combined volume of all of the layers of the golf ball, and wherein the mantle layer has a mantle volume that is the volume of only the mantle layer, and wherein the mantle volume is less than ten percent of the total volume.

In another embodiment, a golf ball having a thin mantle layer made of thermoplastic polyurethane may comprise: an inner core, an outer core surrounding the inner core, a mantle layer surrounding the outer core, wherein the mantle layer comprises thermoplastic polyurethane, and wherein the mantle layer has a mantle thickness and a mantle hardness, and a cover layer surrounding the mantle layer. The cover layer may comprise thermoplastic polyurethane, and the cover layer may have a cover thickness and a cover hardness. The mantle thickness may be at least 0.4 mm less than the cover thickness; and the mantle hardness may be at least about 4 Shore D units greater than the cover hardness.

In a third embodiment, a golf ball having a thin mantle layer made of thermoplastic polyurethane may comprise an inner core comprising a highly neutralized polymer, the inner core having a diameter of about 24-28 mm. The golf ball also may have an outer core layer surrounding the inner core, the outer core may comprise polybutadiene rubber, the outer core may have an outer core thickness of about 7.55-7.75 mm. The golf ball also may have a mantle layer surrounding the outer core, wherein the mantle layer may comprise thermoplastic polyurethane. The mantle layer may have a mantle thickness of about 0.6 mm and a mantle hardness of between about 62 and about 70 on the Shore D scale. The golf ball also may have a cover layer surrounding the mantle layer, wherein the cover layer comprises thermoplastic polyurethane, and wherein the cover layer may have a cover thickness of about 1.0-1.2 mm and a cover hardness of between about 45 and about 58 on the Shore D scale. The golf ball may have a compression of between about 2.4 and about 2.7 when subjected to an initial load of 10 kg and a final load of about 130 kg.

Further description of golf balls having a thin mantle layer made of thermoplastic polyurethane may be found in U.S. patent application Ser. No. 12/627,992 to Ichikawa et al. filed on Nov. 30, 2009, and entitled "Sold Golf Ball with Thin Mantle Layer," the disclosure of which is hereby incorporated by reference.

A golf ball in accordance with this disclosure may include a resilient material. For example, a golf ball including a resilient material may comprise a first layer; a second layer configured to substantially surround the first layer; and wherein at least one of the first layer and the second layer comprises a resilient material, wherein the resilient material has a resilience and a hardness, and wherein the resilience increases as the hardness increases. In some embodiments, a cover layer may comprise the resilient material. The resilient material may be comprised of a thermoplastic polyurethane material containing an isocyanate monomer and a hyper branched polyol having a hydroxyl valence of from about 2.1 to about 36—a "dendritic TPU".

These dendritic TPUs may be prepared from: (A) from about 30 to about 70 parts (by weight of the total reaction mixture) of one or more bio-renewable polyether polyols; (B) from about 15 to about 60 parts (by weight of the total reaction mixture) of one or more polyisocyanates; (C) from about 0.1 to about 10 parts (by weight of the total reaction mixture) of one or more hyper branched polyols having a hydroxy valence of from an about 2.1 to about 36; and (D) from about 10 to about 40 parts (by weight of the total reaction mixture) of one or more chain extenders. Such a dendritic TPU may be prepared by a process comprising the step of: (1) mixing together, in order, optionally the one or more chain extenders, the one or more polyisocyanates, optionally the one or more other polyols, and the one or more hyper branched polyols having a hydroxy valence of from about 2.1 to about 36. This cover material may be advantageous in providing, among other attributes, increased scuff resistance.

Further description of golf balls including a resilient material may be found in U.S. patent application Ser. No. 13/193,025 to Ichikawa, filed on Jul. 28, 2011 and entitled "Golf Ball Having a Resilient Material," the disclosure of which is hereby incorporated by reference.

A golf ball in accordance with this disclosure may include a crosslinked thermoplastic polyurethane. A crosslinked thermoplastic polyurethane may include hard segments and soft segments; wherein the crosslinked thermoplastic polyurethane elastomer includes crosslinks located in the hard segments, the crosslinks being the reaction product of unsaturated bonds located in the hard segments catalyzed by a free radical initiator. The golf ball may include the crosslinked thermoplastic polyurethane specifically in a cover layer, or in any other structural layer.

In a particular embodiment, the crosslinked thermoplastic polyurethane may be the reaction product of:

(a) an organic isocyanate;

(b) an unsaturated diol first chain extender of formula (1)

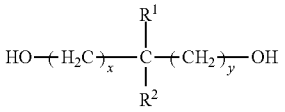

(1)

in which $R^1$ may be any substituted or unsubstituted alkyl, substituted or unsubstituted aryl, substituted or unsubstituted alkyl-aryl group, substituted or unsubstituted ether group, substituted or unsubstituted ester group, any combination of the above groups, or H, and may optionally include an unsaturated bond in any main chain or side chain of any group; $R^2$ may be any suitable substituted or unsubstituted alkyl, substituted or unsubstituted aryl, substituted or unsubstituted alkyl-aryl group, substituted or unsubstituted ether group, substituted or unsubstituted ester group, any combination of the above groups, and $R^2$ includes an allyl group; and x and y are integers independently having any value from 1 to 10;

(c) a long chain polyol having a molecular weight of between about 500 and about 4,000; and (d) a sufficient amount of free radical initiator, so as to be capable of generating free radicals that induce crosslinking structures in the hard segments by free radical initiation.

In another embodiment, the crosslinked thermoplastic polyurethane may include an unsaturated diol represented by formula (2) shown below:

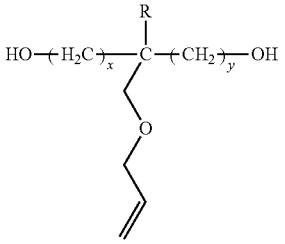

(2)

in which R is a substituted or unsubstituted alkyl group, and x and y are integers independently having values of 1 to 4. In one particular embodiment, the unsaturated diol may be trimethylolpropane monoallylether ("TMPME"). TMPME may also be named "trimethylol propane monoallyl ether", "trimethylol propane monoallylether", or "trimethylolpropane monoallyl ether." TMPME has CAS no. 682-11-1. TMPME may also be referred to as 1,3-Propanediol, 2-ethyl-2-[(2-propen-1-yloxy)methyl] or as 2-allyloxymethyl-2-ethyl-1,3-propanediol. TMPME is commercially available from Perstorp Specialty Chemicals AB.

Further description of golf balls including a crosslinked thermoplastic polyurethane may be found in U.S. patent application Ser. No. 12/827,360 to Chien-Hsin Chou et al. entitled "Golf Balls Including Crosslinked Thermoplastic Polyurethane", and filed on Jun. 30, 2010. Crosslinked thermoplastic polyurethane cover layers are also disclosed in U.S. patent application Ser. No. 13/193,289 to Chien-Hsin Chou et al. entitled "Golf Balls Including A Crosslinked Thermoplastic Polyurethane Cover Layer Having Improved Scuff Resistance", and filed on Jul. 28, 2011. Crosslinked thermoplastic polyurethane cover layers are also disclosed in U.S. patent application Ser. No. 13/193,391 to Chien-Hsin Chou et al. entitled "Four-Piece Golf Balls Including a Crosslinked Thermoplastic Polyurethane Cover Layer." The disclosures of these applications are hereby incorporated by reference.

A golf ball in accordance with this disclosure may include layers having certain flexural modulus and hardness values. For example, a golf ball may respond and feel differently when encountered in a first instance than when encountered in a second instance. This may be accomplished by providing a layered article, where each of the layers has specific material and mechanical properties relative to the other layers. Namely, the ball is provided to have a first feel and response (distance and accuracy) when hit with a driver and a second feel and response (feel and spinnability) when hit with an iron or wedge. For example, the golf ball may be provided with various thermoplastic and thermoset layers. The flexural modulus of each thermoplastic layer may be chosen so that the highest flexural modulus is positioned proximate the surface, though the surface layer has a relatively low flexural modulus. Also, the core, whether single or multi-layer, may have a coefficient of restitution (COR) higher than that of the ball as a whole.

In one embodiment, a ball with layers having certain flexural modulus and hardness values may comprise a first layer, which may be an inner core layer. The first layer may have a first flexural modulus. A second layer may be an outer core layer and may be radially outward of the first layer. A third layer may be an inner cover layer. The third layer may be radially outward of the second layer and may have a second flexural modulus. A fourth layer may be an outer cover layer. The fourth layer may be radially outward of the third layer and may have a third flexural modulus. The second flexural modulus may be greater than the first flexural modulus. The first flexural modulus may be greater than the third flexural modulus.

The second flexural modulus may be at least three times the first flexural modulus. The first layer may have a first coefficient of restitution and the ball may have a second coefficient of restitution and the first coefficient of restitution may be greater than the second coefficient of restitution. A mantle layer may be positioned between the first layer and the fourth layer.

In another embodiment, a ball with layers having certain flexural modulus and hardness values may comprise a first layer, which may be an inner core layer. The first layer may have a first hardness. A second layer may be an outer core layer and may be radially outward of the first layer. The second layer may have a second hardness. A third layer may be an inner cover layer. The third layer may be radially outward of the second layer and may have a third hardness. A fourth layer may be an outer cover layer. The fourth layer may be radially outward of the third layer and may have a fourth hardness. The third hardness may be greater than the first hardness. The third hardness may be greater than the second hardness. The third hardness may be greater than the fourth hardness by at least 10 Shore D.

The first layer may have a first coefficient of restitution and the ball may have a second coefficient of restitution and the first coefficient of restitution may be greater than the second coefficient of restitution. A mantle layer may be positioned between the first layer and the fourth layer.

Further description of golf balls with layers having certain flexural modulus and hardness values may be found in U.S. patent application Ser. No. 12/860,785 to Chen-Tai Liu filed on Aug. 20, 2010, and entitled "Golf Ball Having Layers with Specified Moduli and Hardnesses," the disclosure of which is hereby incorporated by reference.

A golf ball in accordance with this disclosure may include a blend of highly neutralized acid polymers. For example, a golf ball in accordance with this disclosure may include at least one layer comprising a blend of at least first and second highly neutralized acid polymers, each having a Vicat softening temperature and a specific gravity. The absolute value of the difference between the Vicat softening temperatures may be no more than about 15° C. and the absolute value of the difference between the specific gravities is no more than about 0.015. The first Vicat softening temperature may be between about 50° C. and about 60° C., and the second Vicat softening temperature may be between about 40° C. and about 60° C. A ratio of the first highly neutralized acid polymer to the second highly neutralized acid polymer may be from about 20:80 to about 80:20. The first highly neutralized acid polymer and the second highly neutralized acid polymer may be neutralized by the same cation source. In some embodiments, the inner core of the golf ball may comprise the blend of at least first and second highly neutralized acid polymers.

Further description of golf balls with including a blend of at least first and second highly neutralized acid polymers may be found in U.S. patent application Ser. No. 13/194,064 to Hsin Cheng filed on Jul. 29, 2011, and entitled "A Golf Ball Including a Blend Of Highly Neutralized Acid Polymers And Method of Manufacture," the disclosure of which is hereby incorporated by reference.

A golf ball in accordance with this disclosure may include a blend of a first highly neutralized acid polymer having a first Vicat softening temperature and a first specific gravity, a second highly neutralized acid polymer having a second Vicat softening temperature and a second specific gravity, and an ionomer-based masterbatch comprising an additive and an ionomer resin having a third Vicat softening temperature and a third specific gravity. The absolute values of the differences among the Vicat softening temperatures is no more than about 15° C. and the absolute values of the differences among the specific gravities are no more than about 0.015. The ionomer resin may have a third specific gravity and the additive may be a filler having a specific gravity greater than the first, second, and third specific gravities. In particular, the specific gravity of the filler may be greater than the sum of the first, second, and third specific gravities.

In some embodiments, the ionomer-based masterbatch may comprise at least about 55 wt percent additive. The first Vicat softening temperature may be between about 48° C. and about 65° C., the second Vicat softening temperature may be between about 48° C. and about 65° C., and the third Vicat softening temperature may be between about 48° C. and about 65° C.

Further description of golf balls with including a blend of at least first and second highly neutralized acid polymers may be found in U.S. patent application Ser. No. 13/194,094 to Chen Tai Liu et al. filed on Jul. 29, 2011, and entitled "A Golf Ball Including A Blend Of Highly Neutralized Acid Polymers And Method Of Manufacture," the disclosure of which is hereby incorporated by reference. Additional information may also be found in U.S. patent application Ser. No. 13/193,999 to Chen Tai Liu et al. filed on Jul. 29, 2011, and entitled "Method Of Manufacturing A Golf Ball Including A Blend Of Highly Neutralized Acid Polymers," the disclosure of which is hereby incorporated by reference.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball, comprising:

an inner core;

an outer core, the outer core substantially surrounding the inner core;

an inner cover layer, the inner cover layer substantially surrounding the outer core; and an outer cover layer, the outer cover layer substantially surrounding the inner cover layer;

wherein the inner core has a first density value, the first density value being from about 0.85 g/cm$^3$ and about 1.1 g/cm$^3$;

the outer core has a second density value, the second density value being from about 1.05 g/cm$^3$ to about 1.25 g/cm$^3$;

the inner cover layer has a third density value, the third density value being from about 1.05 g/cm$^3$ to about 1.5 g/cm$^3$;

the outer cover layer has a fourth density value, the fourth density value being from about 1 g/cm$^3$ and about 1.8 g/cm$^3$;

the sum of the first density value and the second density value being at least about 2 g/cm$^3$;

the sum of the third density value and the fourth density value being at least about 2.2 g/cm$^3$; and the sum of the third density value and the fourth density value being at least about 0.1 g/cm$^3$ greater than the sum of the first density value and the second density value;

the inner core has a first Shore D hardness value, the outer core has a second Shore D hardness value, the inner cover layer has a third Shore D hardness value, the outer cover layer has a fourth Shore D hardness value;

wherein the third Shore D hardness value is greater than each of the first Shore D hardness value, the second Shore D hardness value, and the fourth Shore D hardness value;

the third Shore D hardness value is at least about 10 Shore D units greater than the fourth Shore D hardness value; and the golf ball has a moment of inertia of from about 82 g-cm$^2$ to about 90 g-cm$^2$.

2. The golf ball of claim 1, wherein the inner core comprises a highly neutralized acid polymer;

the outer core comprises a polybutadiene rubber;

the inner cover layer comprises a non-ionomeric thermoplastic material selected from the group consisting of a polyamide resin, a polyurethane resin, a polyester resin, and combinations thereof;

the outer cover layer comprises a non-ionomeric thermoplastic material selected from the group consisting of a polyamide resin, a polyurethane resin, a polyester resin, and combinations thereof.

3. The golf ball of claim 2, wherein the inner cover layer and the outer cover layer consist essentially of the same material.

4. The golf ball of claim 1 wherein the inner cover layer and the outer cover layer consist essentially of different materials.

5. The golf ball of claim 1, wherein the inner core has a diameter of from about 21 mm to about 30 mm;

the inner cover layer has a thickness of from about 0.5 mm to about 1.2 mm;

the outer cover layer has a thickness of from about 0.6 mm to about 2 mm, the thickness of the outer cover layer being equal to or greater than the thickness of the inner cover layer; and the golf ball has a total diameter of about 1.680 inches.

6. The golf ball of claim 1, wherein the third Shore D hardness value is from about 60 to about 80;

the fourth Shore D hardness value is from about 45 to about 60; and the sum of the third Shore D hardness value and the fourth Shore D hardness value is at least about 120.

7. The golf ball of claim 1, wherein the first density value is from about 0.9 g/cm$^3$ to about 1.1 g/cm$^3$; and the inner core has a diameter of from about 22 mm to about 29 mm.

8. A golf ball, comprising:

an inner core comprising a highly neutralized acid polymer;

an outer core comprising a polybutadiene rubber, the outer core substantially surrounding the inner core;

an inner cover layer comprising a non-ionomeric thermoplastic material selected from the group consisting of a polyamide resin, a polyurethane resin, a polyester resin, and combinations thereof; the inner cover layer substantially surrounding the outer core; and an outer cover layer comprising a non-ionomeric thermoplastic material selected from the group consisting of a polyamide resin, a polyurethane resin, a polyester resin, and combinations thereof; the outer cover layer substantially surrounding the inner cover layer;

wherein the inner core has a first density value, and diameter of from about 21 mm to about 30 mm;

the outer core has a second density value;

the inner cover layer has a third density value, and thickness of from about 0.5 mm to about 1.2 mm;

the outer cover layer has a fourth density value, and a thickness of from about 0.6 mm to about 2 mm, the thickness of the outer cover layer being equal to or greater than the thickness of the inner cover layer;

the sum of the first density value and the second density value being at least about 2 g/cm$^3$;

the sum of the third density value and the fourth density value being at least about 2.2 g/cm$^3$; and the sum of the third density value and the fourth density value being at least about 0.1 g/cm$^3$ greater than the sum of the first density value and the second density value;

the inner core has a first Shore D hardness value, the outer core has a second Shore D hardness value, the inner cover layer has a third Shore D hardness value, the outer cover layer has a fourth Shore D hardness value;

wherein the third Shore D hardness value is greater than each of the first Shore D hardness value, the second Shore D hardness value, and the fourth Shore D hardness value;

the third Shore D hardness value is at least about 10 Shore D units greater than the fourth Shore D hardness value;

the golf ball having a moment of inertia of from about 82 g-cm$^2$to about 90 g-cm$^2$, and the golf ball having a total diameter of about 1.680 inches.

9. The golf ball of claim 8, wherein the inner core consists essentially of one or more highly neutralized acid polymers.

10. The golf ball of claim 8, wherein the inner cover layer consists essentially of at least one of a polyamide resin, a polyurethane resin, a polyester resin, and combinations thereof;

the outer cover layer consists essentially of at least one of a polyamide resin, a polyurethane resin, a polyester resin, and combinations thereof.

11. The golf ball of claim 8, wherein the outer cover layer has a flexural modulus in a range of from about 300 psi to about 5,000 psi.

12. The golf ball of claim 8, wherein the outer cover layer has a flexural modulus in a range of from about 300 psi to about 1,000 psi.

13. The golf ball of claim 8, wherein the inner core layer has a Shore D cross-sectional hardness of from 40 to 60 at any single point on a cross-section obtained by cutting said inner core layer in half, and has a Shore D cross-sectional hardness difference between any two points on the cross-section of within ±6 Shore D units.

* * * * *

UNITED STATES PATENT AND TRADEMARK OFFICE

CERTIFICATE OF CORRECTION

PATENT NO. : 8,764,580 B2
APPLICATION NO. : 13/250305
DATED : July 1, 2014
INVENTOR(S) : Ishii et al.

It is certified that error appears in the above-identified patent and that said Letters Patent is hereby corrected as shown below:

In the Claims

Claim 1, Column 14, line 26, “and” should be --to--.

Claim 1, Column 14, line 35, “and” should be --to--.

Claim 4, Column 15, line 4, “1” should be --2--.

Claim 8, Column 16, line 23, “g-cm$^2$to” should be --g-cm$^2$ to--.

Signed and Sealed this
Twenty-third Day of September, 2014

Michelle K. Lee

Michelle K. Lee
*Deputy Director of the United States Patent and Trademark Office*